US007503260B2

(12) United States Patent
Kapeles

(10) Patent No.: US 7,503,260 B2
(45) Date of Patent: Mar. 17, 2009

(54) NON-LETHAL AMMUNITION

(75) Inventor: John A. Kapeles, Casper, WY (US)

(73) Assignee: Defense Technology Corporation of America, Casper, WY (US)

( * ) Notice: Subject to any disclaimer, the term of this patent is extended or adjusted under 35 U.S.C. 154(b) by 0 days.

(21) Appl. No.: 11/482,280

(22) Filed: Jul. 6, 2006

(65) Prior Publication Data

US 2008/0017064 A1 Jan. 24, 2008

Related U.S. Application Data

(60) Provisional application No. 60/773,843, filed on Feb. 15, 2006.

(51) Int. Cl.
*F42B 8/12* (2006.01)

(52) U.S. Cl. ..... 102/502; 102/444; 102/439

(58) Field of Classification Search ..... 102/502, 102/444, 529, 507, 508, 509, 439
See application file for complete search history.

(56) References Cited

U.S. PATENT DOCUMENTS

| | | | | | |
|---|---|---|---|---|---|
| 2,112,758 | A | * | 3/1938 | Valenti | 102/517 |
| 3,326,133 | A | * | 6/1967 | Stadler et al. | 102/529 |
| 3,650,213 | A | * | 3/1972 | Abbott et al. | 102/436 |
| 3,714,896 | A | | 2/1973 | Young | |
| 3,791,303 | A | * | 2/1974 | Sweeney et al. | 102/502 |
| 3,865,038 | A | * | 2/1975 | Barr | 102/502 |
| 4,603,637 | A | * | 8/1986 | Snide et al. | 102/529 |
| 5,009,164 | A | | 4/1991 | Grinberg | |
| 5,035,183 | A | | 7/1991 | Luxton | |
| 5,086,703 | A | * | 2/1992 | Klein | 102/439 |
| 5,237,930 | A | | 8/1993 | Bélanger et al. | |
| 5,665,808 | A | | 9/1997 | Bilsbury et al. | |
| 5,691,501 | A | * | 11/1997 | Gilbert | 102/444 |
| 5,936,190 | A | * | 8/1999 | Buzick | 102/502 |
| 6,230,630 | B1 | | 5/2001 | Gibson et al. | |
| 6,439,123 | B1 | * | 8/2002 | Dionne et al. | 102/430 |
| 6,543,365 | B1 | * | 4/2003 | Vasel et al. | 102/502 |
| 6,615,739 | B2 | | 9/2003 | Gibson et al. | |
| 7,089,863 | B1 | * | 8/2006 | Dindl | 102/444 |
| 7,143,699 | B2 | * | 12/2006 | Brock et al. | 102/502 |
| 7,207,276 | B1 | * | 4/2007 | Dindl | 102/502 |
| 7,337,725 | B2 | * | 3/2008 | Queiroz de Aguiar | 102/502 |
| 2006/0225600 | A1 | * | 10/2006 | Skellern et al. | 102/502 |
| 2007/0151473 | A1 | * | 7/2007 | Brunn | 102/444 |

OTHER PUBLICATIONS

Ebied, Amer, MESc. Candidate. "*Development of Less Lethal Ammunitions for Peace Keeping.*" The University of Western Ontario, Macromolecular Engineering Research Center (MERC), Pinetree Police Research, 27 pages. Available from http://www.foxlabs.net/powerpoint/AE-LessLethal.pdf. Downloaded Jun. 16, 2006. Material not dated.

* cited by examiner

*Primary Examiner*—James S Bergin
(74) *Attorney, Agent, or Firm*—Christie, Parker & Hale, LLP

(57) ABSTRACT

A non-lethal ammunition comprising a projectile having a nose component, a driving band adjacent the nose component, and a base component, wherein a densified material is used to control weight distribution of the projectile to improve flight, stability and delivered impact energy of the projectile and the nose component includes features to maximize impact surface area. The projectile is positioned within a shell having a high pressure and low pressure propulsion system which minimizes velocity variance of the projectile.

8 Claims, 5 Drawing Sheets

NON-LETHAL AMMUNITION

CROSS-REFERENCE TO RELATED APPLICATION(S)

This application claims the benefit of U.S. Provisional Patent Application No. 60/773,843, filed Feb. 15, 2006, the disclosure of which is hereby incorporated by reference herein.

BACKGROUND OF THE INVENTION

This invention relates to the field of non-lethal impact munition, and more particularly to munition that are intended to fire a projectile at the body of a target to inflict blunt trauma and elicit pain compliance without causing serious bodily injury.

Several impact projectile designs for non-lethal munition are currently available that incorporate some type of compliant nose of the projectile to dissipate energy upon impact with the target. These projectiles are intended to be direct-fired at the target to deliver blunt trauma for pain compliance. For maximum projectile effectiveness, the pain inflicted by the projectile impact must be sufficient to force compliance, yet the delivered energy low enough to prevent serious bodily injury. Total projectile weight and weight distribution are important for projectile stability and effectiveness of the delivered energy. The projectile material of these commercially available designs are usually a low-density plastic or rubber to lessen the impact injury potential. Different methods have been used to increase the projectile weight, such as over-molding a rubber material on a metal slug, or simply using a denser material to mold the entire projectile. These methods do not allow the mass properties of the projectile to be precisely controlled, and in the case of a over-molded slug, can be difficult to manufacture repeatedly.

Operationally, the most important factor for non-lethal munition design is projectile accuracy, which is achieved through the structural design of the projectile as well as maximizing projectile velocity. The most challenging problem for developing an optimum non-lethal munition is to satisfy the competing requirements of maximum velocity, pain compliance, and minimal chance of serious bodily injury when directly fired at the target. The use of compliant noses for the projectile, such as a sponge or foam, dissipate energy upon impact with the target by compression of the foam or sponge by elastic deformation, and the energy required to further compress the sponge or foam increases as the material is compressed. An improved response can be achieved by using a rigid nose material which will crush under an impact load through plastic deformation. The energy required to compress a rigid nose is much higher initially and then drops off as the material fails and a crush zone is formed. The total energy required to deform the nose will depend on the material and its response to impact. To meet the non-lethal performance requirements, energy dissipation through deformation of the nose must be maximized.

Two parameters, namely, blunt trauma inflicted on the human target and the potential for penetration into the body must be considered when designing an impact projectile to be non-lethal. Most non-lethal projectiles have relatively low mass, and are fired at a low velocity, 300-500 feet per second, relative to lethal projectiles. Consequently, the energy transferred to the target is usually not sufficient to cause a serious blunt trauma injury, such as would result from rapid compression of the thoracic cavity during impact. Significant testing has been done to evaluate the parameters associated with blunt trauma injuries from projectile impacts using sophisticated models that simulate compression and deflection of the ribcage and thoracic region. This data has also been compared to injury potential using cadaver test specimens, providing some correlation to the response in the human body.

For the case of penetration, testing has also been done to characterize the energy per unit area required to penetrate the human body using simulated gelatin models, which has also been correlated against cadaver testing. Because the total energy of a non-lethal projectile is relatively low, the controlling parameter for penetration becomes the cross-sectional area of contact when the projectile impacts the target. For larger non-lethal munition, such as 37, 38 or 40 millimeter calibers, the cross-sectional area of impact is usually sufficient to prevent the penetration threshold from being reached, and penetration is highly unlikely. For the case of a 12 gauge projectile, controlling penetration is much more difficult. The small initial diameter can contribute to a fairly high energy per unit area, particularly when the projectile velocity is high to maximize accuracy at longer ranges. With these constraints, one of the only options for the designer is incorporate a feature into the project which expands the impact area through deformation of the projectile nose or body to sufficiently reduce the total energy per unit area to a level below the penetration threshold. Of course, practical considerations prevent some solutions to this problem, such as using a very compliant projectile nose that deforms to a larger surface area on impact. A very compliant nose will also deform as the projectile travels down the barrel of the launcher, engaging the rifling bands and causing damage to the nose material. This scenario will likely affect the spin of the projectile in the rifle bore, and decrease the stability of the projectile in flight.

With the increased use of non-lethal munition by law enforcement, corrections, and military personnel worldwide, there has been a constant need for more effective and higher performing products. The most requested improvements are increased range and increased accuracy, while maintaining the effectiveness of the product with respect to pain compliance and non-lethality. To achieve the optimum range in accuracy in a projectile, it is necessary to maximize the velocity within the constraints of delivered impact energy and penetration potential. As explained above, the diameter of the projectile is a critical factor in determining the lethality parameters. A 12 gauge projectile can exceed the penetration threshold even though the velocity and impact energy are not excessive. Any attempt to decrease the velocity to prevent penetration from occurring will have a negative effect on the range and accuracy of the projectile, as well as decreasing the effectiveness of the blunt impact. The best solution involves controlling the penetration potential by increasing the surface area upon impact, or by designing in a mechanism to dampen or dissipate energy on impact.

Another important parameter for long range non-lethal ammunition is the consistency of the velocity and impact energy over the operational range. This is particularly important when the ammunition is used with a launcher system that is designed to compensate for the range to the target by adjusting the projectile velocity, providing the maximum velocity at the maximum range, and decreasing the velocity proportionally as the range to the target decreases. With this type of system, the impact energy delivered to the target would be relatively constant over the operational range, and the weapons system could be used at short or long range with the same non-lethal performance. For this type of system to work, an inherent problem of non-lethal ammunition must be overcome, which is the wide velocity variance. Typical non-lethal 12 gauge ammunition is relatively light and is fired from shotgun shells using a loose smokeless powder charge. This configuration produces considerable variance in velocity due to the inconsistent burning of the propellant and the looser tolerances of the projectile in the shell.

Consequently, an improved non-lethal ammunition is necessary and the present invention addresses the problem of achieving optimal accuracy and range with a non-lethal impact projectile, while maintaining the critical non-lethal performance parameters. The invention also addresses the specific case of a non-lethal ammunition designed for a specific launcher system that adjusts the velocity of the projectile according to the range of the target, to maintain a relatively constant impact energy at the target independent of range.

SUMMARY OF THE INVENTION

The present invention is an improved non-lethal munition which addresses the problems of prior non-lethal munition designs by incorporating a spin stabilized projectile design that incorporates a projectile body, a driving band to engage barrel rifling and in part spin to the projectile, and a projectile nose which impacts the target and determines the impact surface area. To maximize flight stability of the projectile, the mass properties and weight distribution of the projectile are properly adjusted. For gyroscopic stability, the projectile is designed such that the mass of the projectile is at a uniform distance from a rotational axis, leaving a hollow core in the middle of the projectile. A hollow cavity is in the rear of the projectile and is used to place the maximum amount of mass away from the rotational axis. To further maximize the flight stability, the majority of the weight of the projectile, as well as the center of gravity, is located in the projectile body as opposed to a nose of the projectile. In order to achieve sufficient projectile weight to be effective as an impact projectile, densified materials are used to increase the weight of the projectile body or mid-body components. An example of a densified material is to incorporate a heavy metal powder such as tungsten, lead, iron, etc. into a polymer material, such as polycarbonate, TPE, etc., of the molded base. Other densified materials also are applicable such as bismuth trioxide. The densified materials need to have particulates that are denser than the elastomer. This design allows precise control over both the mass and mass distribution of the projectile while maintaining optimal flight stability.

For some configurations, densification of the entire base may not be practical or feasible, and in such applications a molded, densified disk or ring of material is located at the mid-body of the projectile. A molded disk or ring can be co-molded with the nose or projectile base components, and it allows greater control of the total projectile weight and center of gravity.

The projectile nose is the surface that impacts the target, and determines the degree of compliance, energy dissipation, or surface area increase occurring upon impact. Ideally, the nose should be made of a compliant material that deforms upon impact to increase the contact surface area and absorb or dissipate energy. Due to practical considerations, some degree of rigidity must be maintained so that the deformation does not interfere with the spin up of the projectile in the rifle barrel or with the stability of the projectile while in flight to the target. Many polymer materials, such as two-part polyurethane, TPE, olefin foam, can be tailored to have the desired material properties, but it is difficult to achieve deformation to increase the impact surface area significantly. This is of particular concern for the case of a 12 gauge ammunition, due to the initial small surface area and the associated penetration potential. Several projectile nose designs are incorporated with the present invention which deform in a unique manner to increase the surface area upon impact, but maintain the projectile nose integrity during firing and while in flight. One embodiment incorporates a cavity in the nose of the projectile. Upon impact, the edges of the cavity roll back over the surface of the nose, increasing the surface area. The width and depth of the cavity relative to the overall nose dimensions can be adjusted, along with the nose material hardness, to produce the desired degree of compliance upon impact. A second nose design of the present invention involves the incorporation of slots in the nose that effectively separate the nose into wedge-shaped sections. The slots can be formed by cutting the nose material, or formed during the molding process. Upon impact, these sections are forced apart, increasing the surface area, and absorbing some energy in the deformation of the material. For example, three slots could be used in the nose, but other embodiments with a different number of slots would function in the same manner. Alternatively, the slots molded into the nose could incorporate a thin membrane of material along the nose sidewall. This membrane would provide further rigidity during firing and flight, and would rupture upon impact to allow the nose to open up. The membrane would provide some additional energy dissipation upon impact. The width and depth of the slots can be adjusted along with the nose material to produce the desired compliance.

Another embodiment of the slotted nose design would be the incorporation of an outer membrane covering the molded slots. The outer membrane allows additional rigidity and protection during firing and flight, and ruptures upon impact which dissipates additional energy. After a membrane rupture, the function of the slotted nose is similar to the open slot design that increases the impact surface area. A further variation of the nose design would be molding an internal cavity into the nose which weakens the structure of the nose and allows it to deform and flatten upon impact, producing the desired increase in surface area. Yet another embodiment nose configuration incorporates a frangible nose made of a polymer material that crushes upon impact to dissipate energy. The nose can be filled with a powder or liquid payload, such as a marking agent, irritant, malodorant, or inert material, that is dispersed when the nose crushes.

The propulsion system of the present non-lethal munition of the present invention is a modified high/low pressure design that incorporates a smokeless powder charge confined in a primary high pressure chamber, which exhausts into a secondary low pressure chamber. The two chambers are separated by a rupture disk that must deform before the combustion gases can pass from the high to the low pressure chamber. By adjusting the design of the chambers and the thickness and material of the rupture disk, the propellant can be completely burned before the disk ruptures and the gases impact the projectile in the low pressure chamber. This operation produces very repeatable velocity performance because the projectile sees a relatively uniform pressure force from the burned propellant.

The specific application of this propulsion system design can be for a specialized launcher that attempts to adjust the velocity of the projectile to maintain the same impact energy at close and long ranges. The launcher accomplishes this by bleeding combustion gas from the barrel to achieve the maximum velocity decrease at close range, and then adjusting the amount of bleeding to gradually increase the velocity as the range increases. At the maximum operational range of the launcher, no bleeding occurs, and the maximum muzzle velocity is obtained. For this type of launcher to be effective, it is critical that the velocity variance of the ammunition be minimized. The velocity variance from shot to shot must be significantly less than the velocity adjustments made by the launcher to allow repeatable performance across the operational range. The incorporation of slower burning propellant can be used to tailor the munition for a specific launcher configuration.

DETAILED DESCRIPTION OF THE DRAWINGS

Figure 1:
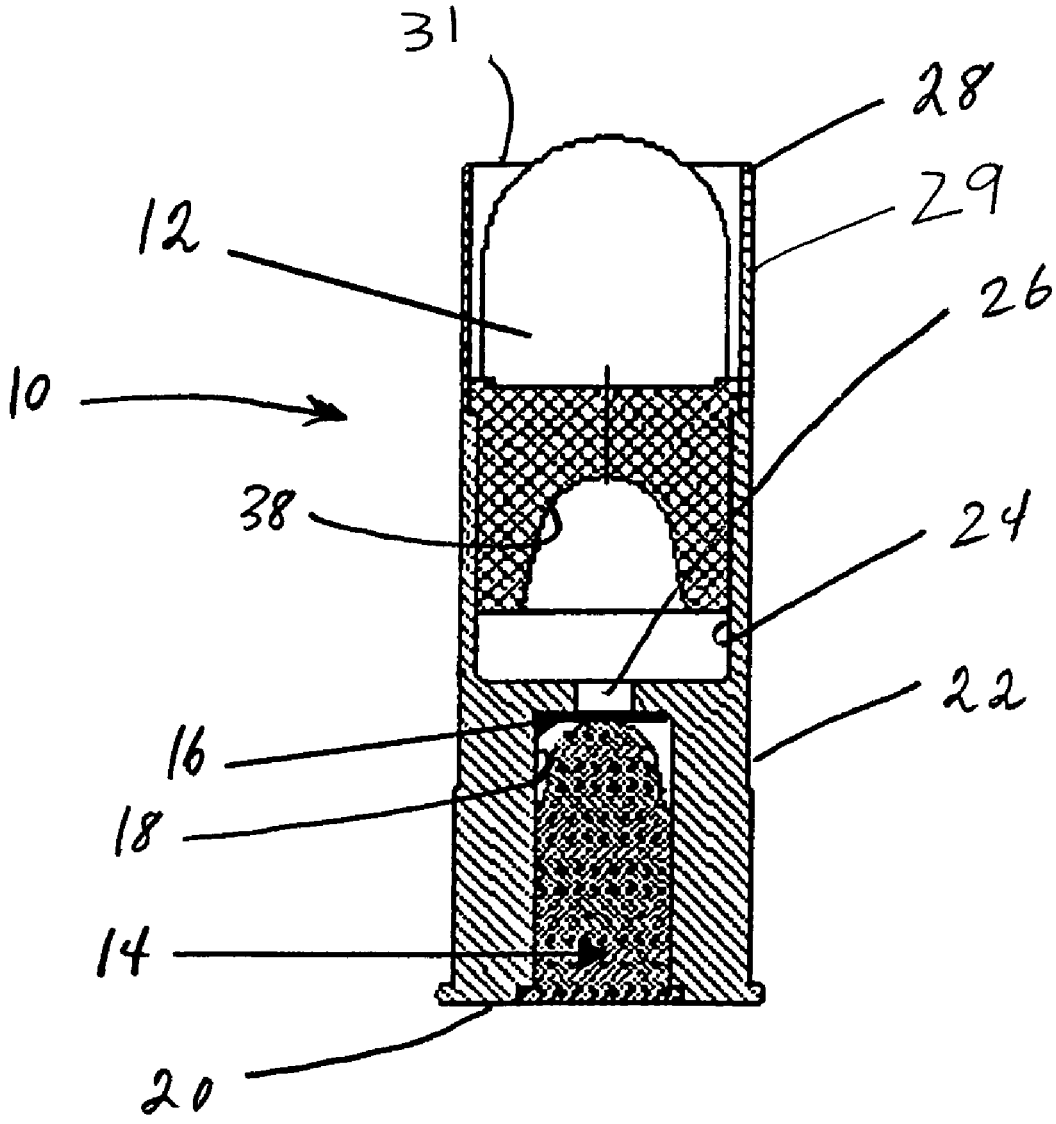
FIG. 1 is a cross-sectional view of a non-lethal ammunition of the present invention, as incorporated into a 12 gauge shotgun shell.
Figure 2:
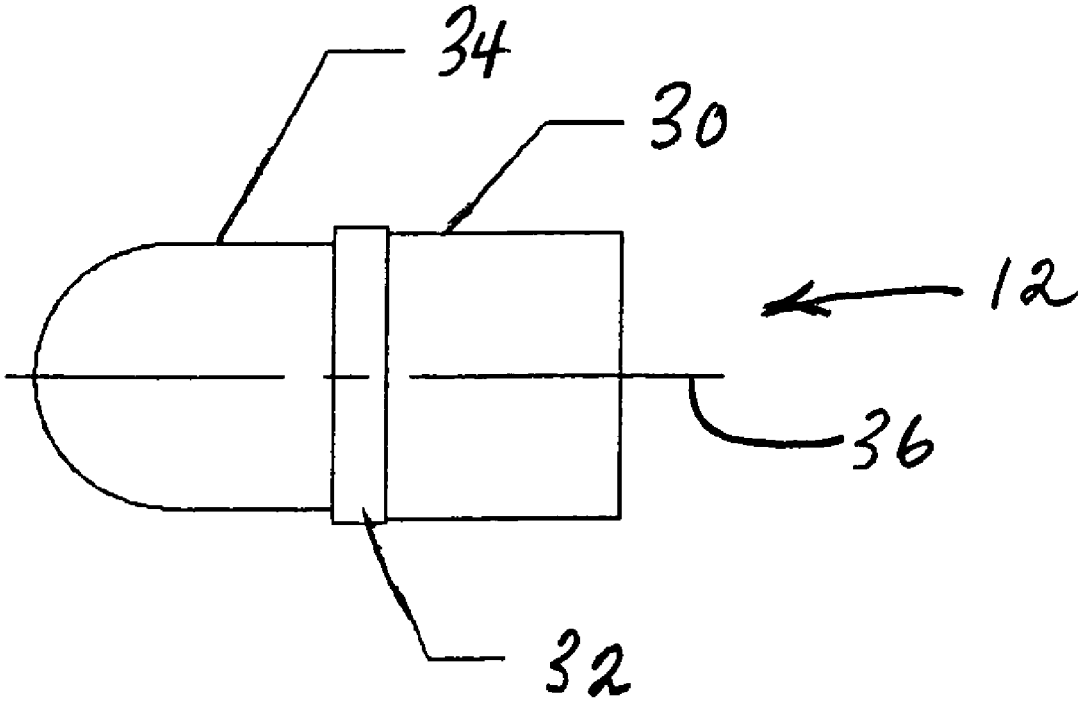
FIG. 2 is a side view of the projectile of FIG. 1.

FIGS. 1 and 2 illustrate a non-lethal munition 10 of the present invention. The non-lethal munition 10 fires a projectile 12 at a victim's body to inflict blunt trauma and elicit pain compliance without causing serious bodily injury. The non-lethal munition 10 illustrated in FIG. 1 is a 12 gauge shell, however, it is to be understood that the principles of the present invention could be applied to any other caliber of projectile such as, for example, 37, 38 or 40 MM.

The munition 10 includes a smokeless high-pressure/low-pressure propulsion system incorporating a blank cartridge 14 and a rupture disk 16 positioned into a high pressure chamber 18 located at one end 20 of the shell casing 22. The high pressure chamber 18 is connected to a low pressure chamber 24 by a vent hole 26. The projectile 12 is positioned in the low pressure chamber 24 located at an opposite end 28 of shell casing 22. The shell casing 22 includes a extension or outer wall 29 which extends up to cover the projectile nose providing protection for the nose component. As will be discussed herein, the nose component has features to make the nose component compliant or frangible which is used to dissipate or absorb energy as well as to increase contact surface area upon impact. This nose design can present challenges when attempting to incorporate the projectile into a practical ammunition system. For example, in 12-gauge munitions, the end of the shotgun shell is typically crimped in a star or roll fashion to retain the projectile in the shell. When fired, the force of breaking through the crimp can be significant, and can cause damage to the projectile nose, negating the non-lethal characteristics of the projectile. One solution would be to load the projectile in such a way that the nose extends above the shell casing 22 where it would not be required to break through any barriers to exit the gun barrel. In this configuration, there is a risk of damage to the nose from handling, storage, transportation, loading, end-to-end stacking in the gun magazine, automatic feeding of ammunition via a belt, or by dropping. Consequently, the side wall 29 of the shell casing 22 can extend up to cover the projectile nose providing protection from the environments mentioned above. This side wall design would be especially useful when incorporating the non-lethal munition of the present invention into a belt-fed configuration for automatic loading into a machine gun or other automatic weapon. The side wall 29 can be any length, and can completely or partially cover the projectile nose. A light membrane 31 or end cover can be placed over the side wall 29 to further protect the projectile from dirt or water without presenting a barrier for the projectile when fired.

The projectile 12 can be a molded one piece construction or multiple components to allow incorporation of different materials and densities, thereby controlling the mass properties of the projectile. The projectile 12 in order to stabilize the spin, incorporates a projectile body 30, also referred to the projectile base, and is located at the back end of the projectile. A driving band 32 is positioned adjacent the projectile body 30 and a projectile nose 34 is located adjacent the driving band. The driving band 32 engages rifling positioned inside the barrel of the launch weapon and in parts spin to the projectile. The projectile nose 34 impacts the target and determines the impact surface area.

To maximize flight stability of the projectile, it is important to properly adjust the mass properties and weight distribution of the projectile. For the specific case of gyroscopic stability, the optimum design places the mass of the projectile at a uniform distance from a rotational axis 36 leaving a hollow core in the middle of the projectile. As shown in FIG. 1, a hollow cavity 38 is located in the rear of the projectile and is used to place the maximum amount of mass away from the rotational axis. To further maximize the flight stability, the majority of the weight of the projectile, as well as the center of gravity, is located in the projectile body as opposed to the nose. In order to achieve sufficient projectile weight to be effective as an impact projectile, densified materials are used to increase the weight of the projectile body or mid-body components. One densification method is to incorporate a dense filler material, such as for example, a heavy metal powder such as tungsten, lead, iron, etc. into a polymer material such as polycarbonate, TPE, etc. of the molded base. This allows precise control over both the mass and the mass distribution of the projectile while maintaining optimal flight stability.

Figure 3:
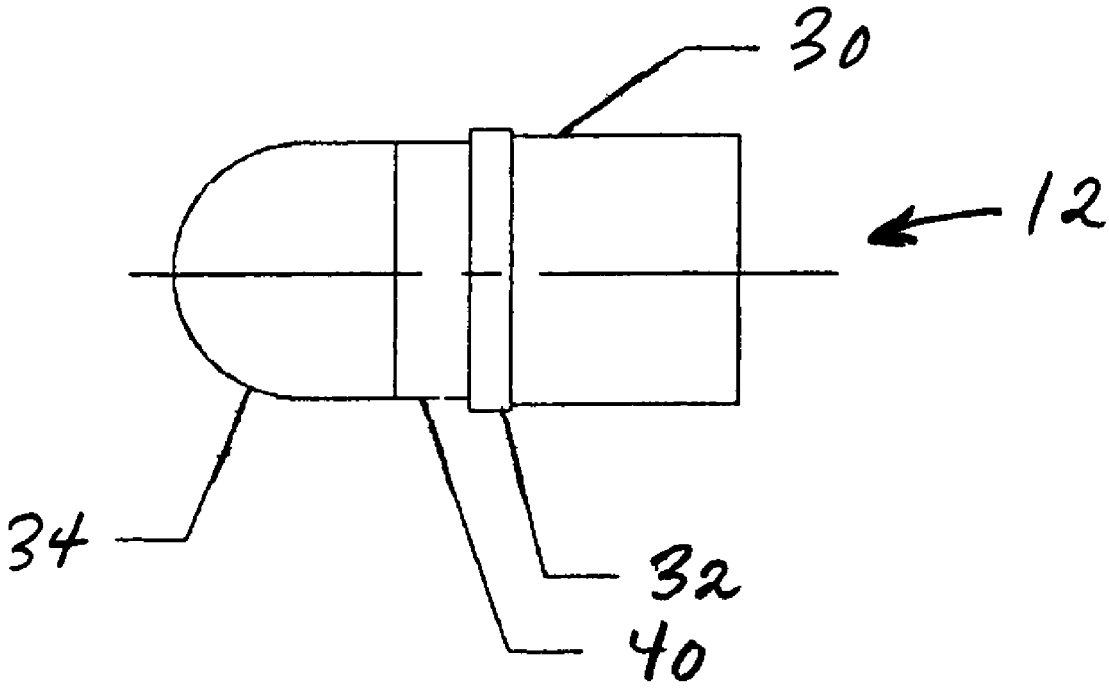
FIG. 3 is a side view of a first alternative projectile design of the present invention.

For some configurations, densification of the entire projectile base may not be practical or feasible. As shown in FIG. 3, a molded, densified disk or ring 40 of material is located at the mid-body of the projectile 12 in between projectile nose 34 and driving band 32. The densified disk or ring 40 can be co-molded with the nose or projectile base components, and provides greater control of the total projectile weight and center of gravity. Alternatively, the projectile can be molded as a single piece.

The projectile nose is the surface of the munition that impacts the target, and determines what degree of compliance, energy dissipation, or surface area increase occurs upon impact. The nose is made of a compliant material that deforms upon impact to increase the contact surface and absorb or dissipate energy. Some degree of rigidity must be maintained so that the deformation does not interfere with the spin up of the projectile in the rifle barrel or with the stability of the projectile while in flight towards the target. Polymer materials such as two-part polyurethane, TPE, olefin foam can be tailored to have the desired material properties, but it is difficult to achieve deformation to increase the impact surface area significantly. This is a particular concern for 12 gauge ammunition, due to the initial small surface area and the associated penetration potential. Several projectile nose designs are intended for the present invention which deform in a unique manner to increase the surface area upon impact, but maintain the projectile nose integrity during firing and while in flight.

Figure 4A:
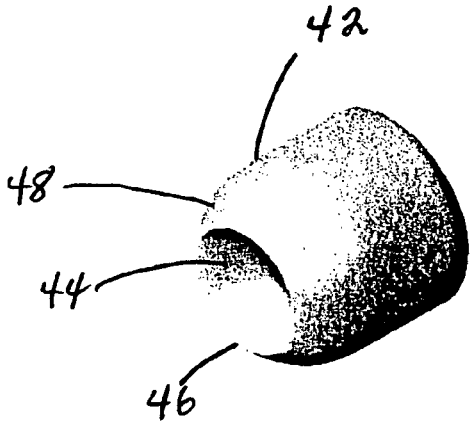
FIG. 4A is a perspective view of an alternative projectile nose design of FIG. 1.
Figure 4B:
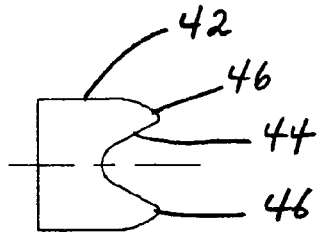
FIG. 4B is a cross-sectional view of the projectile nose of FIG. 4A.

As shown in FIGS. 4A and 4B projectile nose 42 incorporates a cavity 44 which upon impact, edge 46 of the cavity rolls back over the end surface 48 of the nose increasing the surface area. The width and depth of the cavity relative to the overall nose dimensions can be adjusted, along with the nose material hardness, to produce the desired degree of compliance upon impact.

Figure 5:
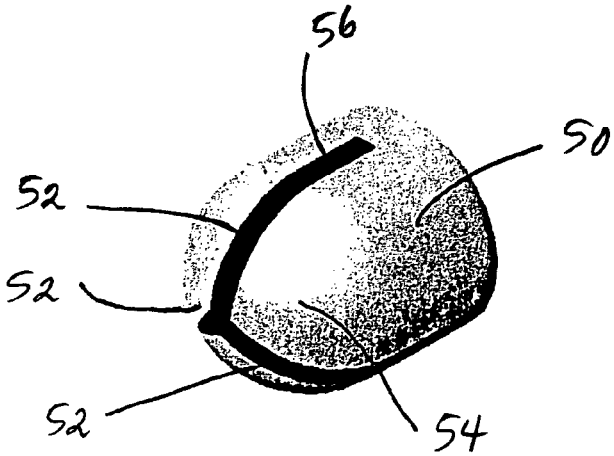
FIG. 5 is a perspective view of a second alternative projectile nose design of FIG. 1.

FIG. 5 illustrates an alternative projectile nose 50 which includes a plurality of slots 52 cut into the end surface 54 of the nose. FIG. 5 illustrates three slots; however, it is to be understood that the number of slots can vary for a specific application. Slots 52 effectively separate the nose into wedge shaped sections. The slots can be formed by cutting the nose material, or formed during a molding process of the projectile. Upon impact, the wedge shaped sections are forced apart increasing the surface area and absorbing some energy in the deformation of the material. Optionally, a thin membrane 56 of material can be molded along a portion of the slots to further provide rigidity of the projectile during firing and flight, and would rupture upon impact to allow the nose to open up. The membrane also provides some additional energy dissipation upon impact. It to be understood that the width and depth of the slots, along with the length of the membrane can be adjusted with the nose material to produce the desired compliance for the projectile.

Figure 6A:
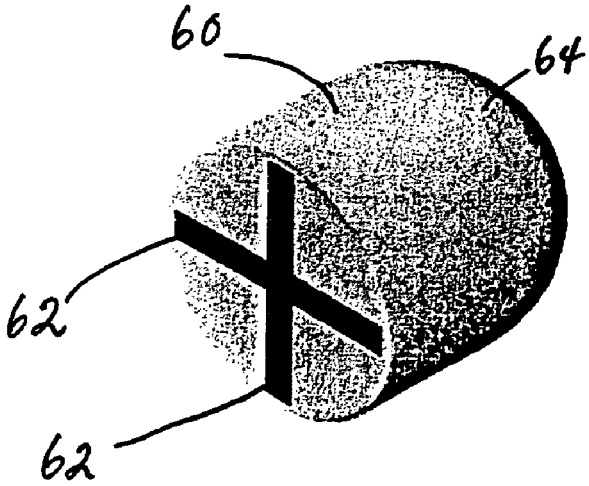
FIG. 6A is a perspective view of a third alternative embodiment projectile nose design of FIG. 1.
Figure 6B:
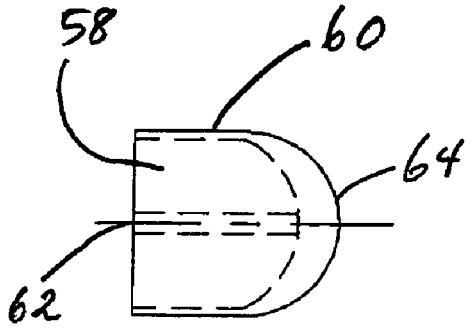
FIG. 6B is a cross-sectional view of the projectile nose of FIG. 6A.

As shown in FIGS. 6A and 6B an internal cavity 58 can be molded into the projectile nose 60 to weaken the structure of the nose and allow it to more easily deform and flatten upon impact producing the desired increase in surface area. This principle would apply to a hollow cylindrical cavity molded into the nose, as well as 2, 3, 4 or other configuration of slots 62. In this embodiment shown in FIGS. 6A and 6B the slots are closed on the impact surface 64 of the projectile nose 60 by a membrane. The projectile nose can also be a frangible nose made of a polymer material that crushes upon impact to dissipate energy. The nose also can be filled with a powder or liquid payload such as a marking agent, irritant, maloderant, or inert material that is dispersed when the nose crushes.

Referring again to FIG. 1 the propulsion system of the present invention is a modified high pressure/low pressure design that incorporates a smokeless powder charge confined in a primary high pressure chamber, which exhausts into a secondary low pressure chamber. The two chambers are separated by a rupture disk that must deform before the combustion gases can pass from the high pressure chamber to the low pressure chamber. By adjusting the design of the chambers and the thickness and material of the rupture disk, the propellant can be completely burned before the disk ruptures and the gases impact the projectile in the low pressure chamber.

This propulsion system is designed for a specialized launcher which adjusts the velocity of the projectile to maintain the same impact energy at close and long ranges. The launcher accomplishes this goal by bleeding combustion gas from the barrel to achieve the maximum velocity decrease at close range, and then adjusting the amount of bleeding to gradually increase the velocity as the range increases. At the maximum operational range of the launcher, no bleeding occurs, and the maximum muzzle velocity is obtained. For this type of launcher to be effective, it is critical that the velocity variance of the ammunition be minimized. The velocity variance from shot to shot must be significantly less than the velocity adjustments made by the launcher to allow repeatable performance across the operational range. For a 12 gauge launcher configuration, the propulsion system incorporates dimensional details and slower burning propellant tailored for this configuration.

The present invention provides advantages over prior designs in that it has the ability to solve the combined problems of accuracy at long range, effective non-lethal impact performance, and addresses the specific requirements of a specialized non-lethal launcher system that adjusts projectile velocity as a function of range. The non-lethal ammunition of the present invention is intended for use as an impact munition for law enforcement, corrections, or military users that will deliver blunt trauma upon impact with the body. The munition also provides a marking or irritant payload. The munition provides greatly improved accuracy in range compared to other non-lethal products commercially available. The munition preferably is designed to be fired from a 12 gauge rifled-barrel launcher system or shotgun, but could also be used with other calibers that utilize a rifled barrel.

Although the present invention has been described and illustrated with respect to specific embodiments thereof, it is to be understood that changes and modifications can be made which are within the full intended scope of the invention as hereinafter claimed.

What is claimed is:

1. A non-lethal projectile comprising:

a solid nose component of compliant material;

a base component, and means on the nose component to increase impact surface area of the projectile, wherein the means on the nose component to increase impact surface area includes at least one slot extending into the nose component from a contact end surface of the nose component, whereby the slot separates the nose component into distinct sections that can deform and spread out upon impact with a target.

2. The projectile of claim 1 further comprising means to control weight distribution of the projectile.

3. The projectile of claim 2 wherein the means to control weight distribution includes a densified disk component to maximize a mass of the projectile at a uniform radial distance from an axis of rotation of the projectile to optimize gyroscopic stability of the projectile.

4. The projectile of claim 2 wherein the means to control weight distribution includes a hollow cavity extending from an end surface of the base component opposite the nose component.

5. The projectile of claim 1 wherein the means on the nose component to increase impact surface area further includes a cavity extending into the nose component from a contact end surface of the nose component.

6. The projectile of claim 1 wherein a membrane is positioned at least partially in the slot to provide rigidity of the nose component during firing and flight of the projectile, the membrane being capable of rupturing upon impact.

7. The projectile of claim 6 wherein the membrane entirely covers the slot.

8. The projectile of claim 1 wherein the projectile further includes a driving band adjacent the nose component.

* * * * *